US007753662B2

(12) United States Patent
Lai et al.

(10) Patent No.: US 7,753,662 B2
(45) Date of Patent: Jul. 13, 2010

(54) MINIATURE LIQUID COOLING DEVICE HAVING AN INTEGRAL PUMP THEREIN

(75) Inventors: Cheng-Tien Lai, Tu-Cheng (TW); Zhi-Yong Zhou, Shenzhen (CN); Qiao-Li Ding, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 965 days.

(21) Appl. No.: 11/309,748

(22) Filed: Sep. 21, 2006

(65) Prior Publication Data

US 2008/0075611 A1 Mar. 27, 2008

(51) Int. Cl.
*F04B 17/00* (2006.01)
*H05K 5/00* (2006.01)

(52) U.S. Cl. ..... 417/423.9; 417/420; 417/423.7; 417/423.12; 417/423.14; 417/423.15; 165/80.4; 165/80.5; 361/699

(58) Field of Classification Search ..... 417/420, 417/423.1, 423.7, 423.8, 423.9, 423.12, 423.14, 417/423.15, 424.1; 165/80.4, 80.5; 361/699
See application file for complete search history.

(56) References Cited

U.S. PATENT DOCUMENTS 5,423,376 A 6/1995 Julien et al.
6,575,231 B1 * 6/2003 Wu ..... 165/121
7,249,625 B2 * 7/2007 Duan ..... 165/80.4
7,312,986 B2 * 12/2007 Tomioka et al. ..... 361/679.48
7,371,056 B2 * 5/2008 Ito et al. ..... 417/353
2005/0178526 A1 * 8/2005 Naganawa et al. ..... 165/80.2
2005/0249609 A1 * 11/2005 Ito et al. ..... 417/353
2005/0276703 A1 * 12/2005 Lee et al. ..... 417/410.1
2006/0051222 A1 * 3/2006 Lee et al. ..... 417/423.14
2006/0185829 A1 * 8/2006 Duan et al. ..... 165/104.33
2007/0224059 A1 * 9/2007 Lai et al. ..... 417/423.12
2008/0053641 A1 * 3/2008 Lai et al. ..... 165/120

FOREIGN PATENT DOCUMENTS

CN 100385370 C 4/2008
TW 273031 * 8/2005

* cited by examiner

*Primary Examiner*—Devon C Kramer
*Assistant Examiner*—Leonard J Weinstein
(74) *Attorney, Agent, or Firm*—Jeffrey T. Knapp

(57) ABSTRACT

A miniature liquid cooling device includes a casing (10) defining a first chamber (102), a second chamber (104) and a third chamber (106) communicating with the first chamber. The first and the third chambers cooperatively form a work channel for liquid. An impeller (21) is rotatably mounted in the first chamber to circulate the liquid. A filter (17) is mounted in the second chamber and defines a plurality of orifices (1704). When the impeller rotates, first the liquid firstly enters the second chamber via an inlet. (122), and then the liquid flows through the filter within the second chamber, whereby air bubbles in the liquid leave the liquid and escape from the filter via the orifices. The escaped air bubbles enter the second chamber. The deaerated liquid flows into the work channel and finally is driven to low out of the liquid cooling device via an outlet (124).

14 Claims, 5 Drawing Sheets

MINIATURE LIQUID COOLING DEVICE HAVING AN INTEGRAL PUMP THEREIN

FIELD OF THE INVENTION

The present invention relates generally to a liquid cooling device for cooling electronic components, and more particularly to a miniature liquid cooling device having an integral pump therein, wherein the pump has a filter for preventing air bubbles from entering a work channel for liquid of the pump.

DESCRIPTION OF RELATED ART

With continuing development of the computer technology, electronic packages such as central process units (CPUs) are generating more and more heat that requires immediate dissipation. The conventional heat dissipating devices such as combined heat sinks and fans do not have sufficient heat dissipation capacity to serve the needs of modern electronic packages. Liquid cooling systems are therefore increasingly being used in computer technology to cool these electronic packages.

A related liquid cooling system comprises a heat absorbing unit for absorbing heat from a heat source, and a heat dissipating unit which is filled with liquid. The liquid conducts heat exchange with the heat absorbing unit, thereby taking away the heat of the heat absorbing unit as the liquid is circulated. Typically, a miniature pump separated from the heat absorbing unit is used to circulate the liquid.

The pump comprises an inlet for inputting liquid and an outlet for outputting liquid. The inlet and the outlet are in communication with an inner space of the pump where an impeller having blades is installed. The liquid is circulated in the liquid cooling system by rotation of the impeller. The pump is unable to directly connect with the heat source, which results in a high cost. Furthermore, a problem existing in the related liquid cooling system is that during an operation thereof air is frequently entrapped by and dissolved into the liquid in the inlet of the pump. When the pump stops, the air dissolved in the liquid precipitates therefrom in a form of bubbles in a chamber of the pump. Since the chamber of the pump is substantially closed, the bubbles cannot easily leave the chamber. When the pump is operated again, these bubbles flow with the liquid, which causes the performance of the pump to be lowered; the heat exchange efficiency of the liquid is negatively affected; the level of noise during operation of the pump is increased; the total heat dissipation quality of the liquid cooling system deteriorates.

Therefore, it is desirable to provide a liquid cooling device which overcomes the foregoing disadvantages.

SUMMARY OF INVENTION

A miniature liquid cooling device in accordance with an embodiment of the present invention for removing heat from a heat-generating electronic component includes a casing defining a first chamber, a second chamber and a third chamber communicating with the first chamber. The first and the third chambers cooperatively form a work channel for liquid of the liquid cooling device. An impeller is rotatably mounted in the first chamber to circulate the liquid. A filter is mounted in the second chamber and defines a plurality of orifices. When the impeller rotates, the liquid firstly enters the second chamber via an inlet and flows through the filter. Air bubbles in the liquid escape from the liquid and enter a room defined by a portion of the second chamber via the orifices. The liquid, after being deaerated, flows into the work channel and finally is driven to flow out of the liquid cooling device via an outlet thereof. Thus, the disadvantages caused by the air bubbles in the liquid in the related art is avoided.

Other advantages and novel features of the present invention will become more apparent from the following detailed description of the preferred embodiment when taken in conjunction with the accompanying drawings, in which:

DESCRIPTION OF DRAWINGS

Many aspects of the present device can be better understood with reference to the following drawings. The components in the drawings are not necessarily drawn to scale, the emphasis instead being placed upon clearly illustrating the principles of the present device. Moreover, in the drawings, like reference numerals designate corresponding parts throughout the several views.

DETAILED DESCRIPTION

Figure 1:
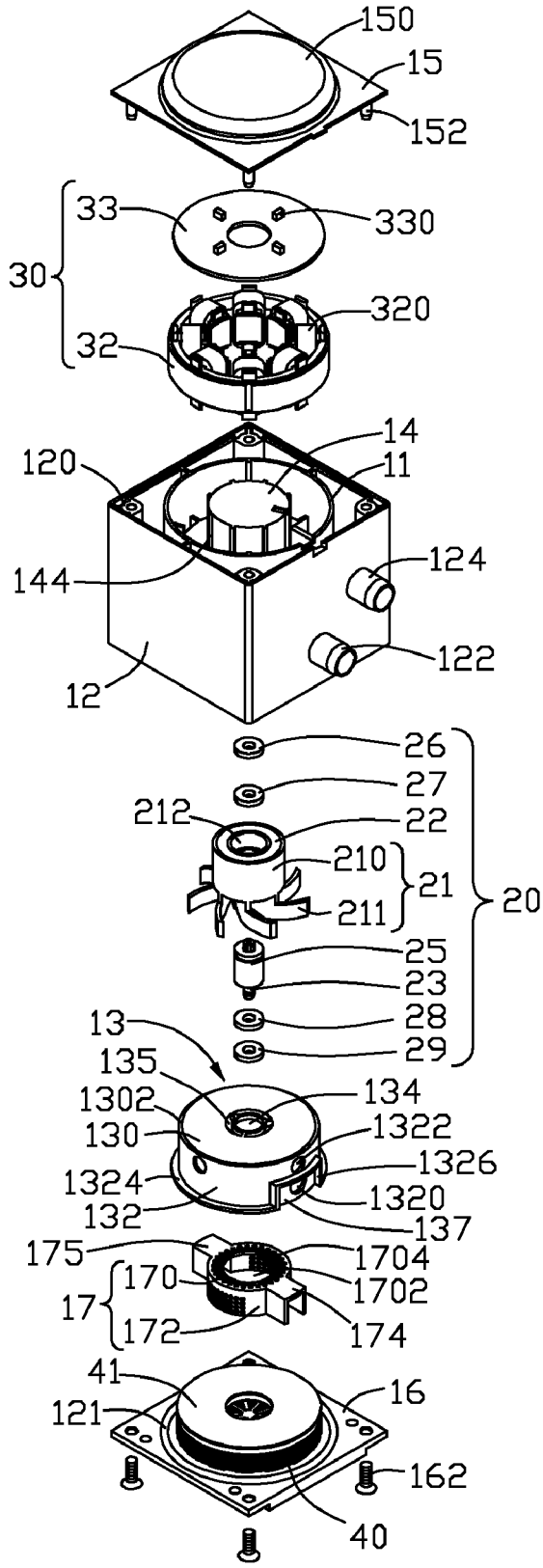
FIG. 1 is an exploded, isometric view of a miniature liquid cooling device according to a preferred embodiment of the present invention.
Figure 2:
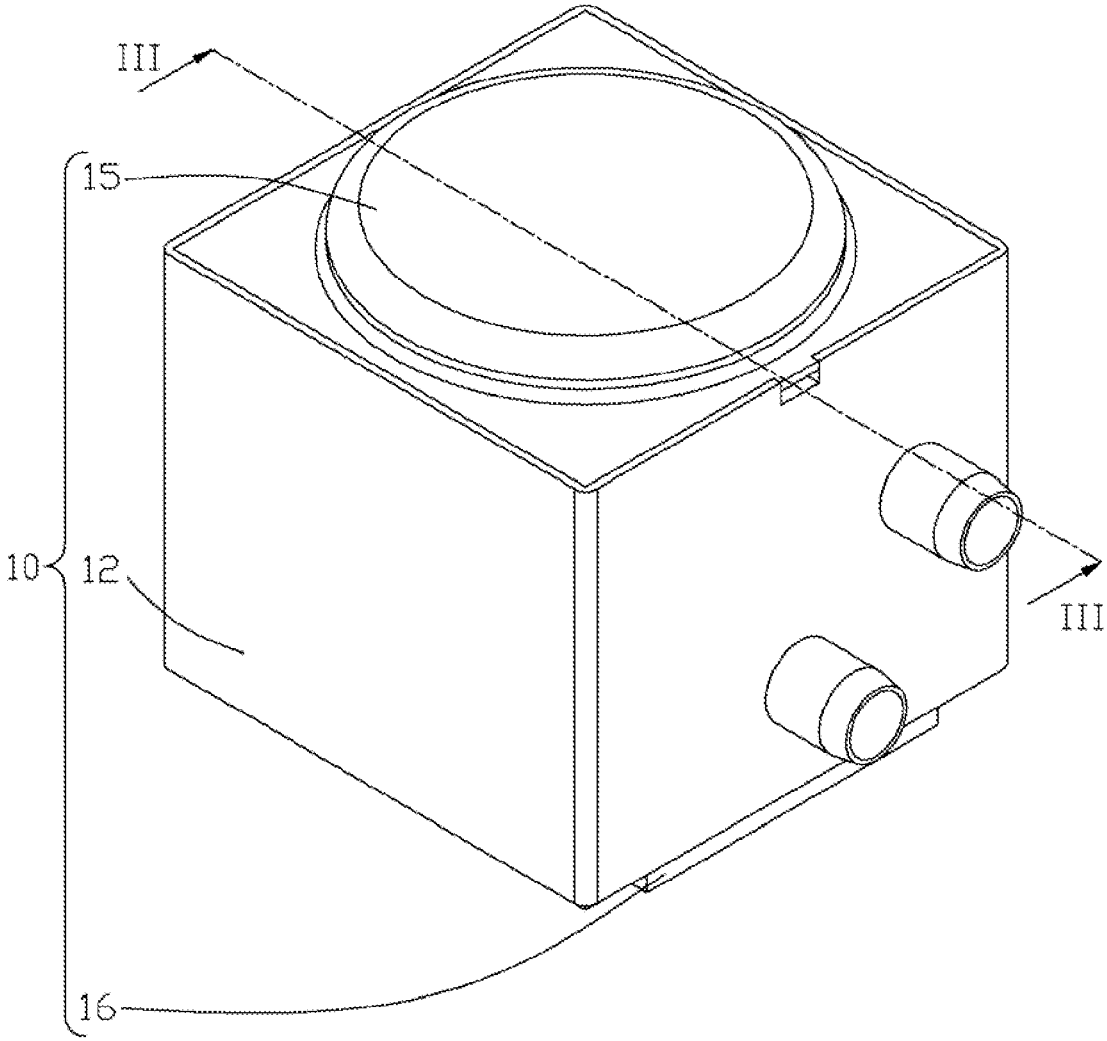
FIG. 2 is an assembled view of the miniature liquid cooling device of FIG. 1.
Figure 3:
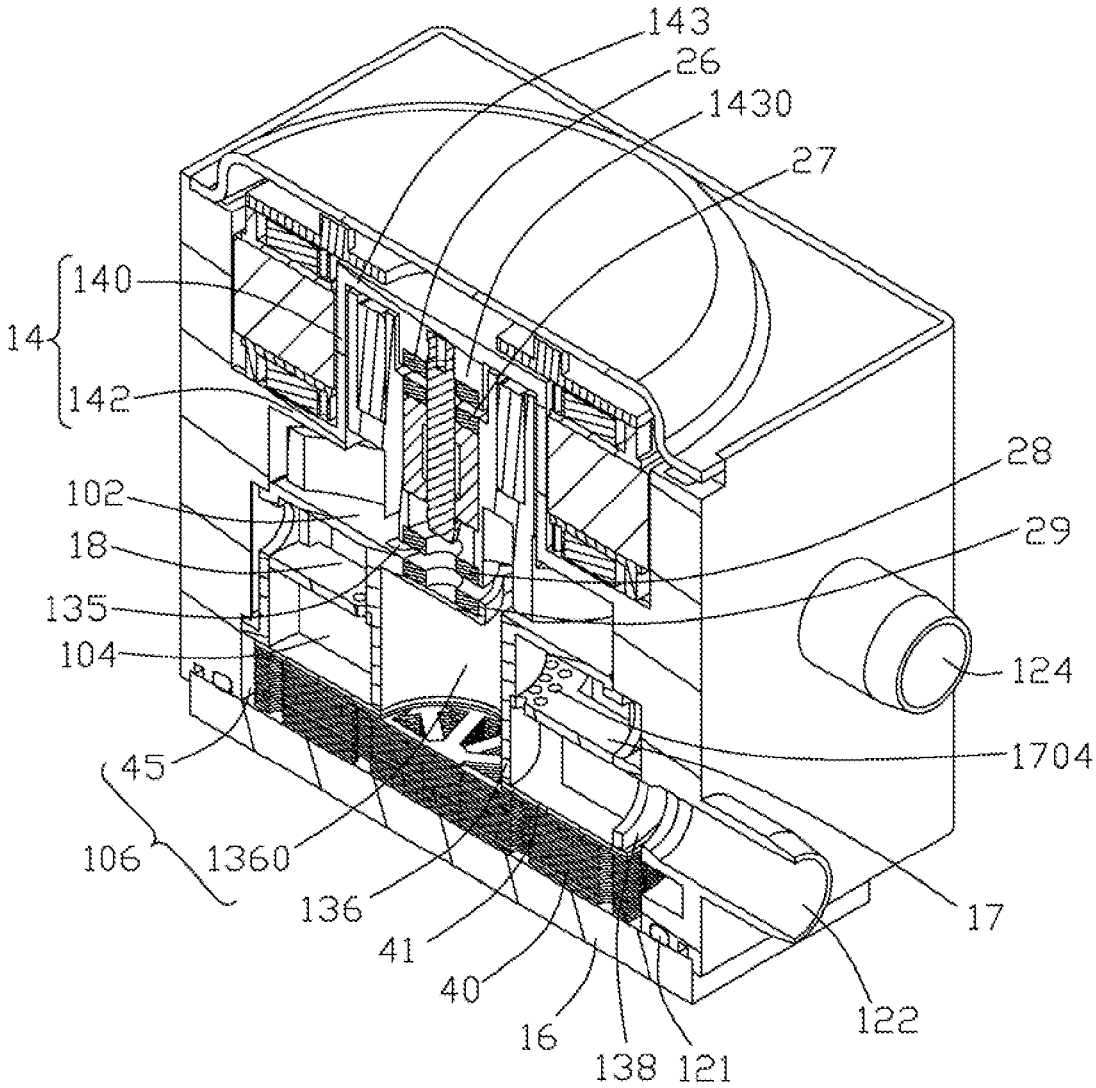
FIG. 3 is a cross-sectional view taken along line III-III of FIG. 2.

Referring to FIGS. 1-3, a miniature liquid cooling device in accordance with a preferred embodiment of the present invention comprises a casing 10 having an inner space, a liquid circulating unit 20, a motor driving unit 30, a filter 17 and a heat-absorbing member 40 received in the inner space of the casing 10. The liquid cooling device can be directly attached to a heat-generating electronic component (not shown) mounted on a printed circuit board (not shown).

The casing 10 has a cubical-shaped configuration. A hollow main body 14 is received in the inner space of the casing 10, for accommodating the liquid circulating unit 20 therein. The casing 10 comprises an outer wall 12, a top cover 15 attached to a top end of the outer wall 12, and a bottom base 16 attached to a bottom end of the outer wall 12. A hollow cylinder 11 connecting with the outer wall 12 and the main body 14 is received in the inner space of the casing 10 and located between the outer wall 12 and the main hollow body 14. A sealing ring 121 is disposed between the outer wall 12 and the bottom base 16 to prevent liquid leakage therebetween. The outer wall 12 of the casing 10 has four hollow posts 120 formed at four corners thereof. An inlet 122 is formed on the outer wall 12 of the casing 10 for allowing the liquid to enter the casing 10. An outlet 124 is also formed on the outer wall 12 of the casing 10 for allowing the liquid to exit the casing 10. The outlet 124 is located above the inlet 122.

The main body 14 is used for isolating the motor driving unit 30 from the liquid and comprises first and second bodies 140, 142 each having a cylindrical configuration. The first body 140 has a top wall 143. A plurality of ribs 144 are formed on an outer surface of the first body 140 along an axial direction thereof. The second body 142 communicates with the first body 140 and has a diameter larger than that of the first body 140. A sidewall (not labeled) of the second body 142 connects with the cylinder 11.

Figure 4:
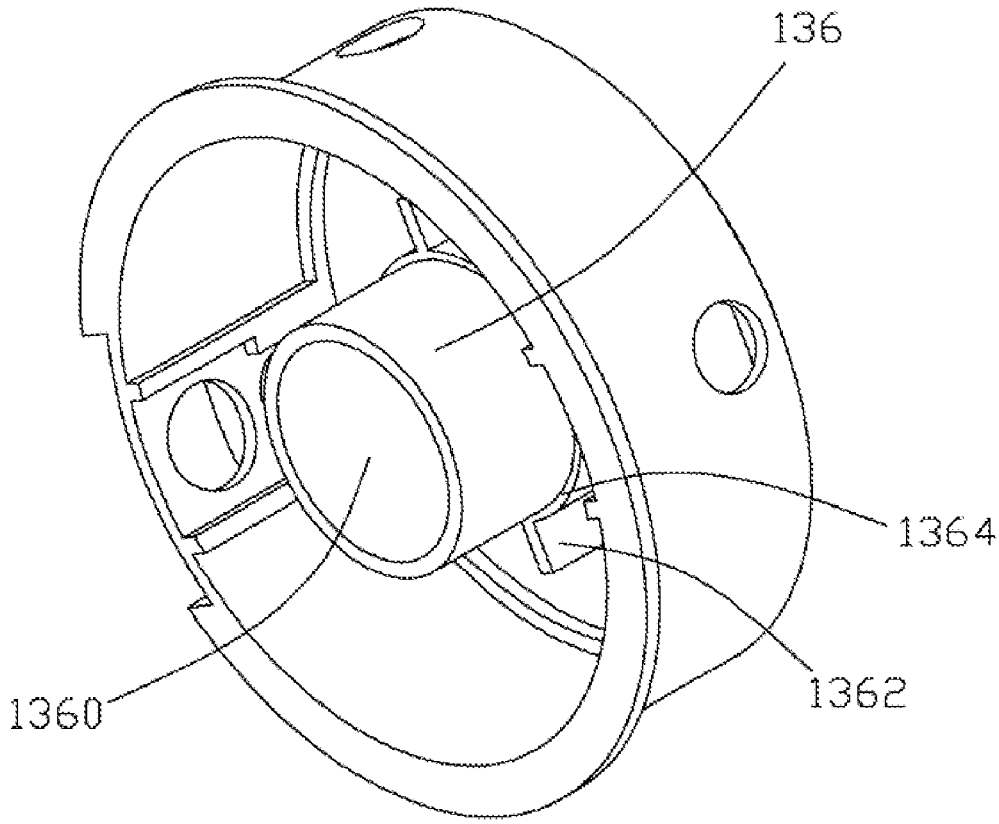
FIG. 4 is an enlarged view of a mask of the miniature liquid cooling device of FIG. 1.

An air circulating mask 13 is received in the inner space of the casing 10 and located below a bottom end (not labeled) of the second body 142 of the main body 14. The mask 13 comprises a circular top plate 130 attached to the bottom end of the second body 142 of the main body 14 and a cylindrical sidewall 132 downwardly extending from an edge of the top plate 130. An annular step 1302 is formed between the top plate 130 and the sidewall 132 for hermetically engaging with the bottom end of the second body 142 of the main body 14. An arced fringe 1324 circumferentially extends from a bottom edge of the sidewall 132, for engaging with a corresponding portion (not labeled) of the cylinder 11. A reversed U-shaped fringe 1326 connects with two free ends of the arced fringe 1324. An entry area 137 is enclosed by the fringe 1326, being in alignment with the inlet 122. An aperture 1320 is defined at a center of the entry area 137, corresponding to the inlet 122. The reversed U-shaped fringe 1326 abuts against a corresponding portion (not labeled) of the cylinder 11 so that a space 138 is defined between the entry area 137 and the cylinder 11 for permitting the liquid to downwardly flow through the heat-absorbing member 40 located below the mask 13. The liquid enters the mask 13 only via the aperture 1320 defined in the entry area 137. A plurality of through holes 1322 are circumferentially defined in the wall 132 and located above the aperture 1320. A supporting cylindrical wall 136 extends downwardly from a bottom of the top plate 130 of the mask 13 for abutting against the heat-absorbing member 40. An inner chamber 1360 is enclosed by the supporting cylindrical wall 136. A recess 134 is defined in a center of the top plate 130. The top plate 130 defines a plurality of elongated arced through openings 135 communicating with the inner chamber 1360. The through openings 135 are located adjacent to and circularly around the recess 134, and communicate with an inner space (not labeled) of the main body 14 with the inner chamber 1360 for providing passage of the liquid therethrough. Referring to FIG. 4, an annular step 1364 is circularly formed on the supporting cylindrical wall 136. A pair of baffle plates 1362 abutting against the top plate 130 are formed at two opposite sides of the annular step 1364.

The filter 17 is received in the mask 13 and located around the supporting cylindrical wall 136 of the mask 13. The filter 17 comprises a top wall 170 and a cylindrical sidewall 172. A central opening 1702 is defined in the top wall 170 for providing passage of the supporting cylindrical wall 136 of the mask 13. A plurality of orifices 1704 are defined in the top wall 170 and the cylindrical sidewall 172 for providing escape of air bubbles mixed in the liquid therefrom. The top wall 170 abuts against the annular step 1364 and the baffle plates 1362 of the mask 13 to separate the top wall 170 from the top plate 130 of the mask 13 for facilitating escape of the air bubbles therefrom. A pair of flanks 174, 175 are formed at two opposite sides of the sidewall 172. The flank 174 is located at a position corresponding to the entry area 137 of the mask 13. The flank 175 abuts against an inner surface (not labeled) of the sidewall 132 of the mask 13. The flank 174 is in alignment with the aperture 1320 of the mask 13 so that the liquid can directly enter the filter 17 via the aperture 1320 and the flank 174.

The bottom base 16 has a rectangular configuration. The bottom base 16 is mounted on the bottom end of the outer wall 12 by bringing four screws 162 to extend through the base 16 and screw into the posts 120 of the outer wall 12. The bottom base 16 serves as a heat-absorbing plate to contact with the heat-generating electronic component and absorb heat generated by the electronic component.

The liquid circulating unit 20 is received in the main body 14. The liquid circulating unit 20 comprises an impeller 21, a shaft 23 mounted on the top wall 143 of the main body 14 and a bearing 25 pivotably attached to the shaft 23. The impeller 21 comprises a cylindrical hub 210 having a permanent magnet 22 embedded therein and a plurality of curved blades 211 radially extending from a bottom end of the hub 210. The hub 210 has a central through hole 212 for receiving the shaft 23 and the bearing 25 therein. For positioning the shaft 23, the top wall 143 of the main body 14 downwardly forms a shaft support 1430 having a center blind hole (not labeled) fixedly receiving a top end of the shaft 23 therein. In the present invention, the impeller 21 uses four annular magnetic spacers 26-29 to control its axial position, wherein the magnetic spacers 27, 28 are respectively received in two opposite ends of the through hole 212 of the impeller 21 and rotate with the impeller 21. The magnetic spacers 26, 29 are respectively received in the shaft support 1430 and the round recess 134 of the top plate 130 of the mask 13. The magnetic spacers 26, 27 are mounted around the shaft 23 and located above the bearing 25. The magnetic spacers 28, 29 are located below the bearing 25. The magnetic spacers 26, 27 have opposite polarities, while the magnetic spacers 28, 29 have opposite polarities. Thus, the four magnetic spacers 26-29 properly suspend the impeller 21 in a stable position in the axial direction when the impeller 21 is driven to rotate with the bearing 25.

The motor driving unit 30 is mounted on the main body 14, and comprises a stator 32 and a printed circuit board 33 mounted on and electrically connecting with the stator 32. The stator 32 is mounted around the first body 140 of the main body 14 in the casing 10 and engages with the ribs 144 of the first body 140. The stator 32 is supported by the second body 142 of the main body 14 in an axial direction and supported by the cylinder 11 in a radial direction. The printed circuit board 33 is mounted on the top wall 143 of the main body 14 and electrically connected with the stator 32. The stator 32 has a plurality of coils 320 which are used for providing paths for currents controlled by the printed circuit board 33 to flow therethrough. When the currents flow through the coils 320, magnetic fields are produced to interact with the permanent magnet 22 to cause the impeller 21 to rotate.

The top cover 15 has a square configuration. A cap 150 protrudes upwardly from a center of the top cover 15 for covering and thermally contacting with electronic components 330 mounted on the printed circuit board 33. The top cover 15 is made of a highly thermal conductive material. In this embodiment of the present invention, the material of the top cover 15 is made of aluminum, for dissipating heat generated by the electronic components 330 mounted on the printed circuit board 33. Four poles 152 extend downwardly from four corners of the top cover 15, for being engaged in the posts 120 of the outer wall 12 of the casing 10, thereby securing the top cover 15 to the outer wall 12.

Figure 5:
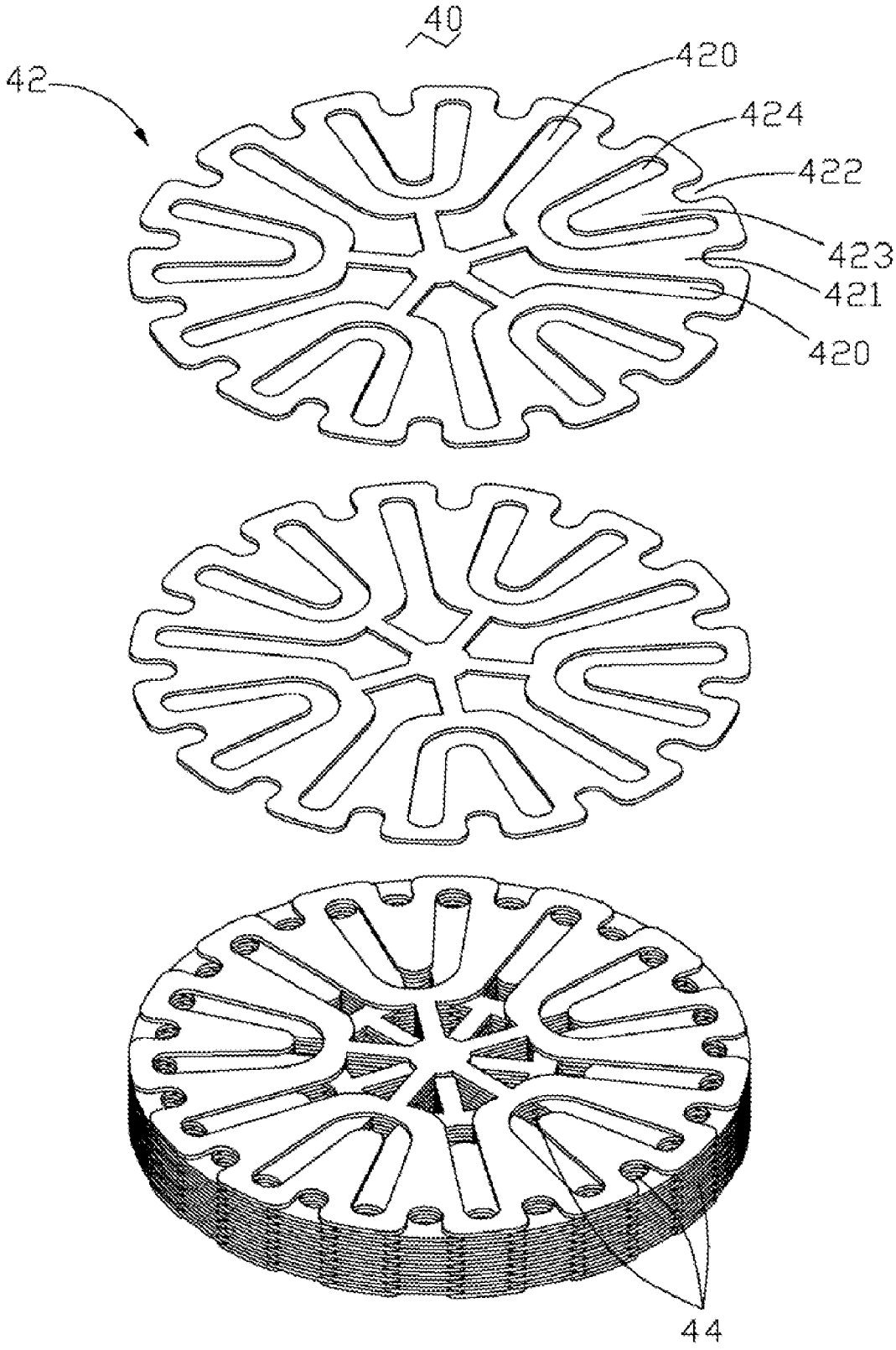
FIG. 5 is a partially exploded and enlarged view of a heat-absorbing member of the miniature liquid cooling device of FIG. 1.

Referring to FIGS. 3 and 5, the heat-absorbing, member 40 is mounted on the bottom base 16 for absorbing the heat generated by the electronic component. The heat-absorbing member 40 is made of highly thermal conductive material such as copper or copper alloy. In this embodiment of the present invention, the heat-absorbing member 40 includes a plurality of copper pieces 42. Each of the copper pieces 42 has a configuration like an annular flake and defines five evenly spaced elongated slots 420 extending along a radial direction thereof. A plurality of evenly spaced cutouts 422 is circumferentially defined at an outer edge of each piece 42. A body 421 is formed and located between two adjacent elongated slots 420 of each piece 42. The body 421 defines a substantially V-shaped aperture 424 extending along the radial direction of the piece 42. A tab 423 is enclosed by the V-shaped aperture 424. The tab 423 has a length shorter than that of the slot 420. During assembly of the pieces 42, the pieces 42 are coaxially stacked on each other to form the heat-absorbing member 40, wherein the tabs 423 of each piece 42 are stacked on the elongated slots 420 of an adjacent piece 42 to form a plurality of channels 44 through the heat-absorbing member 40.

A mounting plate 41 is attached on the heat-absorbing member 40 for abutting against the supporting cylindrical wall 136 of the mask 13, thereby supporting the mask 13 thereon. The mounting plate 41 defines a central hole (not labeled) therein communicating with channels 44 defined in the heat-absorbing member 40. The supporting cylindrical wall 136 is mounted around the central hole of the mounting plate 41. Thus, the inner chamber 1360 of the supporting cylindrical wall 136 communicates with the channels 44 of the heat-absorbing member 40.

In the present invention, the main body 14, the top plate 130 of the mask 13, the supporting cylindrical wall 136 of the mask 13 and the mounting plate 41 divide the casing 10 into a first chamber 102, a second chamber 104 and a third chamber 106. The first chamber 102 is enclosed by an inner surface of the main body 14 and the top plate 130 of the mask 13 for receiving the liquid circulating unit 20 therein. The second chamber 104 is enclosed by an inner surface of the cylinder 11, the top plate 130 of the mask 13, an outer surface of the supporting cylindrical wall 136 of the mask 13 and the mounting plate 41. This means that the second chamber 104 is a space sandwiched between the top plate 130 of the mask 13 and the mounting plate 41, except at the inner chamber 1360 of the supporting cylindrical wall 136. The third chamber 106 includes the inner chamber 1360 and a space 45 sandwiched between the mounting plate 41 and the bottom base 16. The third chamber 106 communicates with the first chamber 102 via the through openings 135 defined in the top plate 130 of the mask 13. The first chamber 102 and the third chamber 106 cooperatively form a work channel for the liquid. In the second chamber 104, a room 18 is defined in a portion thereof by an outer surface of the filter 17 and an inner surface of the mask 13 for accommodating the air bubbles leaving the liquid.

In operation of the liquid cooling device, first the liquid enters the filter 17 mounted in the second chamber 104 via the inlet 122 and the flank 174 of the filter 17. The liquid entering the second chamber 104 continues to move, due to inertia, along an inner surface of the filter 17, but slows down due to gravity; simultaneously, the air bubbles mixed in the liquid, due to the slowdown of the flowing speed of the liquid, have time to leave the liquid and escape from the filter 17 via the orifices 1704 defined in the filter 17. The escaped air bubbles finally enter the room 18 of the mask 13. Air generated by the air bubbles in the room 18 can leave the room 18 through the through holes 1322 defined in the wall 132 of the mask 13. After circularly flowing through the filter 17, the deareated liquid returns to the entry area 137 of the mask 13 via the aperture 1320 and flows downwardly along an edge of the heat-absorbing element 40 to the third chamber 106. The bottom base 16 intimately contacts with the electronic component and absorbs the heat generated by the electronic component. The heat is then transferred to the liquid contained in the third chamber 106 via the heat-absorbing member 40. The liquid flows through the channels 44 and exchanges the heat with the heat-absorbing member 40. Thereafter, the liquid flows towards the first chamber 102 via the through openings 135 of the mask 13. The liquid in the first chamber 102 is finally discharged out of the first chamber 102 via the outlet 124 by a centrifugal force generated by rotation of the impeller 21.

In the present invention, due to the provision of the filter 17 and the room 18, the air bubbles mixed in the liquid can escape from the liquid before the liquid flows through the work channel of the liquid cooling device. The air bubbles cannot enter the work channel of the liquid cooling device. Thus, the problems that happen in the related art due to the air bubbles in the liquid are avoided in the liquid cooling device in accordance with the present invention. The cooling efficiency and performance of the liquid cooling device in accordance with the present invention is accordingly improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid cooling device, comprising:

a casing defining a first chamber, a second chamber, and a third chamber, the third chamber communicating with the first chamber, an inlet and an outlet being formed on the casing, the first and the third chambers cooperatively forming a work channel for liquid;

an impeller rotatably mounted in the first chamber to circulate the liquid, a magnet attached to the impeller;

a heat-absorbing member being mounted in the third chamber, adapted for absorbing heat from a heat-generating electronic component, the heat-absorbing member defining a plurality of channels therein communicating with the third chamber;

a mask located between the impeller and the hear-absorbing member;

a filter mounted in the second chamber and received in the mask, the filter having a flank located corresponding to the inlet, the filter defining a plurality of orifices to provide an escape of air bubbles mixed in the liquid for preventing the air bubbles from entering the work channel with the liquid; and a motor driving unit interacting with the magnet attached on the impeller to drive the impeller to rotate;

wherein when the impeller rotates, first the liquid enters the second chamber via the inlet, and then the liquid flows through the filter in which the air bubbles in the liquid leave the liquid and escape from the filter via the orifices defined in the filter to enter a room defined by a portion of the second chamber, and then the liquid, after being deaerated, flows into the work channel and finally is driven to flow out of the liquid cooling device via the outlet.

2. The liquid cooling device of claim 1, wherein the heat-absorbing member comprises a plurality of annular, flake-like pieces coaxially stacked together.

3. The liquid cooling device of claim 1, wherein the mask comprises a top plate and a cylindrical sidewall extending from an edge of the top plate, and the cylindrical sidewall defines an aperture corresponding to the inlet and the flank of the filter.

4. The liquid cooling device of claim 3, wherein a supporting cylindrical wall extends from a bottom of the top plate of the mask for abutting against the heat-absorbing member, an inner chamber being enclosed by an inner surface of the supporting cylindrical wall and defining a portion of the third chamber, the inner chamber communicating with the first chamber and with the channels of the heat absorbing member.

5. The liquid cooling device of claim 4, wherein the filter is mounted around the supporting cylindrical wall of the mask.

6. The liquid cooling device of claim 5, wherein the filter comprises a top wall spaced from the top plate of the mask and a cylindrical sidewall, the plurality of orifices being defined in the top wall and the cylindrical sidewall of the filter.

7. The liquid cooling device of claim 4, wherein a mounting plate is mounted on the heat-absorbing member, and the supporting cylindrical wall abuts against the mounting plate.

8. The liquid cooling device of claim 7, wherein the mounting plate defines a central hole to communicate the inner chamber enclosed by the supporting cylindrical wall of the mask with the channels of the heat-absorbing member.

9. The liquid cooling device of claim 7, wherein a main hollow body is provided in the casing for isolating the motor driving unit from the liquid, the top plate of the mask hermetically attached to a bottom end of the main hollow body, and the top plate of the mask and an inner surface of the main hollow body forms the first chamber.

10. The liquid cooling device of claim 9, wherein the second chamber is located between the top plate of the mask and the mounting plate and outside of the inner chamber enclosed by the supporting cylindrical wall of the mask.

11. The liquid cooling device of claim 10, wherein the casing comprises a bottom base attached to the heat-absorbing member, and the third chamber comprises the inner chamber enclosed by the supporting cylindrical wall of the mask and a space located between the mounting plate and the bottom base.

12. The liquid cooling device of claim 9, wherein a shaft is mounted on a top wall of the main body, a bearing being pivotably attached to the shaft and the impeller being attached to the bearing to rotate with the bearing.

13. The liquid cooling device of claim 12, wherein the impeller uses two pairs of annular magnetic spacers to control its axial position, the first pair of magnetic spacers are positioned above the bearing and spaced from each other, and the second pair of magnetic spacers are positioned below the bearing and spaced each other, the first pair of magnetic spacers having opposite polarities, and the second pair of magnetic spacers having opposite polarities.

14. The liquid cooling device of claim 9, wherein the motor driving unit comprises a stator and a printed circuit board electrically connecting with the stator, the stator being mounted around the main hollow body, the printed circuit board being mounted on the stator.

* * * * *